US007229506B2

(12) United States Patent
Giordani et al.

(10) Patent No.: US 7,229,506 B2
(45) Date of Patent: Jun. 12, 2007

(54) PROCESS FOR PICKLING MARTENSITIC OR FERRITIC STAINLESS STEEL

(75) Inventors: Paolo Giordani, Crema (IT); Dario Negri, Bagnolo Cremasco (IT); Mauro Rigamonti, Opera (IT)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 10/860,911

(22) Filed: Jun. 4, 2004

(65) Prior Publication Data

US 2005/0016634 A1 Jan. 27, 2005

Related U.S. Application Data

(63) Continuation of application No. PCT/EP02/13415, filed on Nov. 28, 2002.

(51) Int. Cl.
*C23G 1/02* (2006.01)

(52) U.S. Cl. ..... 134/41; 510/258; 510/260; 134/2; 134/3; 134/26; 134/27; 134/28; 134/29; 134/30; 134/32; 134/34; 134/35; 134/36; 134/42

(58) Field of Classification Search ..... 510/258, 510/260; 134/2, 3, 26, 27, 28, 29, 30, 32, 134/34, 35, 36, 41, 42
See application file for complete search history.

(56) References Cited

U.S. PATENT DOCUMENTS

| | | | | |
|---|---|---|---|---|
| 2,115,005 | A * | 4/1938 | Blaut et al. | 205/674 |
| 5,332,446 | A * | 7/1994 | Didier et al. | 134/3 |
| 5,810,939 | A * | 9/1998 | Angel et al. | 134/2 |
| 5,843,240 | A * | 12/1998 | Pedrazzini et al. | 134/3 |
| 5,851,304 | A * | 12/1998 | Giraud et al. | 134/3 |
| 5,908,511 | A * | 6/1999 | Bianchi | 134/3 |
| 6,174,383 | B1 * | 1/2001 | Angel et al. | 134/41 |
| 6,210,491 | B1 * | 4/2001 | Colgan et al. | 134/10 |
| 6,210,558 | B1 * | 4/2001 | Demertzis et al. | 205/746 |
| 6,554,908 | B1 * | 4/2003 | Negri et al. | 134/3 |
| 6,565,735 | B1 * | 5/2003 | Fortunati et al. | 205/704 |
| 2002/0174880 | A1 * | 11/2002 | Madi et al. | 134/3 |
| 2003/0121568 | A1 * | 7/2003 | Giordani et al. | 148/259 |
| 2004/0031696 | A1 * | 2/2004 | Campioni et al. | 205/704 |

FOREIGN PATENT DOCUMENTS

| | | | |
|---|---|---|---|
| DE | 197 55 350 | A1 | 6/1999 |
| EP | 0 582 121 | A1 | 2/1994 |
| EP | 0 505 606 | B1 | 11/1995 |
| EP | 0769575 | * | 4/1997 |
| EP | 0 795 628 | A1 | 9/1997 |
| EP | 1050605 | A2 * | 11/2000 |
| WO | WO95/35397 | * | 12/1995 |
| WO | WO97/43463 | * | 11/1997 |
| WO | WO 00/15880 | A1 | 3/2000 |
| WO | WO 01/49899 | A2 | 7/2001 |

OTHER PUBLICATIONS

Ullmanns Encyklopadie der technischen Chemie, 4th Edition, vol. 22, pp. 102-112.
Stainless steels; technical delivery conditions for plates, hot rolled strip, wire rods, drawn w bars, forgings and semi-finished product, DIN 17 440, pp. 1-26 (1985).

* cited by examiner

*Primary Examiner*—Sharidan Carrillo
(74) *Attorney, Agent, or Firm*—Stephen D. Harper; Mary K. Cameron

(57) ABSTRACT

A process for pickling martensitic or ferritic stainless steel, preferably in the form of wires, tubes or rods, wherein the stainless steel is placed in contact with a pickling solution which has a temperature in the range 15 to 29° C. and contains 50 to 120 g/l of free sulfuric acid, 5 to 40 g/l of free HF and 5 to 40 g/l of Fe(III) ions. Such pickling may be incorporated into a sequential process, wherein the stainless steel is a) subjected to a treatment during which the oxidic coating is applied, preferably sand-blasting or metal-blasting, treatment with a molten salt or treatment with an aqueous permanganate/alkali metal hydroxide solution, b) pickled in accordance with the aforedescribed process, and c) post-treated with a passivating solution.

22 Claims, No Drawings

PROCESS FOR PICKLING MARTENSITIC OR FERRITIC STAINLESS STEEL

This application is a continuation under 35 USC Sections 365(c) and 120 of International Application No. PCT/EP02/13415, filed 28 Nov. 2002 and published 12 Jun. 2003 as WO 03/002683, which claims priority from German Application No. 10160318.5, filed 7 Dec. 2001, each of which is incorporated herein by reference in its entirety.

FIELD OF THE INVENTION

The invention provides a process for pickling martensitic or ferritic stainless steel (also called "rust-resistant" steel), in particular in the form of wires, tubes or rods.

DISCUSSION OF THE RELATED ART

In everyday language, non-rusting or rust-resistant steels are those in which the formation of rust is inhibited under conventional environmental conditions such as, e.g., the presence of atmospheric oxygen and moisture and in aqueous solutions. More highly alloyed steels, so called corrosion-resistant or acid-resistant steels, are mostly resistant to more severe corrosive conditions such as, for example, acids and salt solutions. As a group, these steels are called stainless steels. A list of the most important industrial stainless steels, along with their material numbers, names and alloy components as well as their mechanical and chemical properties is given in Ullmanns Encyklopädie der technischen Chemie, 4th edition, volume 22, pp. 106-112 and in German Industrial Standard DIN 17440, July 1985. Stainless steels are iron-based alloys which contain at least 10% chromium. The formation of chromium oxide on the surface of the material provides stainless steels with a corrosion-resistant character.

Stainless steels can be subdivided into the following families: austenitic steels, ferritic steels, martensitic steels, age-hardened steels and duplex steels. These groups differ in their physical and mechanical properties and also in their resistance to corrosion, properties which depend on the different alloy constituents.

A layer of oxide scale is formed on the surface during the annealing or hot-rolling etc. of stainless steel and this removes the desired shiny metallic appearance of the steel surface. Therefore this surface layer has to be removed after this production step. This can be performed using the pickling process according to the invention. The oxide-containing surface layer to be removed differs fundamentally from the oxide layer on low-alloyed steels or on carbon steels. Apart from iron oxides, the surface layer contains oxides of the alloy elements such as, for example, chromium, nickel, aluminum, titanium or niobium. On heating, the surface layer becomes enriched with chromium oxide because chromium is a thermodynamically less noble metal than iron. This means that chromium becomes more enriched than iron in the oxide layer. Conversely, this also means that the layer of steel immediately below the oxide layer becomes depleted in chromium. A pickling process using suitable acid pickling solutions preferentially dissolves this chromium-depleted layer below the oxide layer so that the oxide layer peels off.

After pickling, the surface is chemically activated so that, in air, it again becomes covered with an optically problematic surface layer. This can be prevented by passivating the freshly pickled surface during or after the pickling process.

This may be performed in treatment solutions similar to the pickling solutions, wherein however a higher redox potential is used for passivation than for the pickling process. An optically invisible passivating layer is produced on the metal surface by the targeted passivation step. The steel surface retains its shiny metallic appearance in this way. Whether the treatment solution acts in a pickling or passivating manner towards stainless steel depends mainly on the redox potential which is used. Acid solutions with a pH less than about 2.5 act as pickling solutions when they have a redox potential, relative to a silver/silver chloride electrode, in the range of about 100 to about 350 mV, due to the presence of oxidising agents. If the redox potential is increased to values above about 350 mV, the treatment solution acts in a passivating manner, wherein different minimum values for the potential have to be used depending on the type of stainless steel.

Pickling processes for stainless steel are very well known in industry. Older processes use nitric acid-containing pickling baths. These often also contain hydrofluoric acid which promotes the pickling process due its complexing effect with iron ions. Although these types of pickling baths are economically efficient and technically satisfactory, they have the large ecological disadvantage that they emit considerable amounts of nitric oxides and that high concentrations of nitrate are present in the aqueous effluents. The suction devices required make the process more costly and the amounts of nitrogen oxide ultimately reaching the atmosphere have a considerable potential for damaging the environment.

Therefore intensive efforts to find alternative pickling and passivating processes which do not involve the use of nitric acid have been made in the industry. One possible substitute for the oxidising effect of nitric oxide is that of Fe(III) ions. The concentration of these can be maintained, for example, by hydrogen peroxide which is added continuously or intermittently to the treatment baths. These types of pickling or passivating baths contain about 15 to about 65 g/l of trivalent iron ions. Trivalent iron ions are reduced to the divalent state during the pickling process. At the same time, further divalent iron ions are leached out of the pickled surface. Therefore the pickling bath becomes depleted in trivalent iron ions during this operation, while it becomes enriched in divalent iron ions. The redox potential of the treatment solution is thus shifted so that the solution finally loses its pickling effect.

Divalent iron ions are oxidized back to the trivalent state by the continuous or intermittent addition of oxidizing agents such as, for example, hydrogen peroxide or other oxidizing agents such as perborates, peracids or even organic peroxides. The redox potential required to produce the pickling or passivating effect is maintained in this way.

For example, EP-B-505 606 describes a nitric acid-free process for pickling and passivating rust-resistant steel in which the material to be treated is placed in contact with a bath which has a temperature between 30 and 70° C. and which, at least at the start of the pickling process, contains at least 150 g/l sulfuric acid, at least 15 g/l Fe(III) ions and at least 40 g/l HF. Furthermore, this bath contains up to about 1 g/l of additives such as non-ionic surfactants and pickling inhibitors. Amounts of hydrogen peroxide are added to the bath, continuously or intermittently, so that the redox potential is maintained within the desired range. The other constituents are also topped up in such a way that their concentration remains within the optimum working range. The pickling bath is agitated by blowing air through it. Agitation of the bath is required in order to produce uniform pickling results. A similar process, which differs substantially from the preceding one only by the redox potential which is used, is described in EP-A-582 121.

The previously mentioned pickling processes operate in a satisfactory manner on an industrial scale and have the ecological advantage that no nitrogen oxides are emitted to the atmosphere. They are optimised in particular to the pickling of austenitic stainless steels which constitute about 65 to 85% of the stainless steel market. For items made of martensitic or ferritic stainless steel, in particular when these are present in the form of wires, tubes or rods, however, these pickling solutions have proven to be too aggressive. They attack the basic alloy in these types of steel too strongly, so there is a risk of overpickling. The pickling procedure continues in depth at already pickled points and breaks up the surface. As a result of overpickling, more divalent iron ions are produced than are required and these have to be oxidised to the trivalent state in order to maintain the redox potential. This increases the consumption of oxidising agent and thus makes the pickling process more costly. Furthermore, the quantity of iron salts which has to be subsequently disposed of also increases. Therefore there is a need for a less aggressive pickling process with which items made of martensitic or ferritic stainless steel can be reliably pickled so that surface coatings are removed but overpickling does not occur.

BRIEF SUMMARY OF THE INVENTION

The present invention provides a process for pickling martensitic or ferritic stainless steel, wherein the stainless steel is placed in contact with a pickling solution which contains Fe(III) ions, sulfuric acid and HF, and wherein the pickling solution has a temperature in the range 15 to 29° C. and contains
50 to 120 g/l of free sulfuric acid
5 to 40 g/l of free HF and
5 to 40 g/l of Fe(III) ions.

DETAILED DESCRIPTION OF CERTAIN EMBODIMENTS OF THE INVENTION

The concentrations of the individual components in this pickling bath each lie within a range which is known per se from the prior art. However, the concentrations, relative to each other, are such that no overpickling of martensitic or ferritic substrates takes place. An essential parameter for avoiding overpickling is the temperature which, according to the invention, is adjusted to be between 15 and 29° C. It is preferably between 20 and 29° C. and in particular between 23 and 28.5° C. If the temperature exceeds 30° C. there is an increasing risk of overpickling.

The duration of the pickling process depends on the temperature selected, the concentrations of free acids used and pretreatment of the items before the actual pickling process. The pickling time is in the region of about 5 minutes for substrates treated by sand-blasting and/or metal blasting, 10 to 15 minutes for substrates treated in molten salts and 10 to 25 minutes for pretreatment using a strongly alkaline solution of potassium permanganate. It may be necessary to repeat the steps pretreatment and pickling to obtain a completely successful pickling procedure. The pickling times mentioned then apply to the relevant individual steps.

In the case of the previously mentioned concentrations of free sulfuric acid and free HF, it should be noted that each of these is the concentration of the free acid. Acid anions which are present in the form of salts are not taken into account here. The minimum concentration of free hydrofluoric acid depends on the pickling time that is considered to be acceptable. The concentration of free HF is preferably at least 10 g/l, in order to achieve the previously mentioned pickling times. The maximum concentration may in practice lie in the range between about 25 and about 30 g/l. If particularly short pickling times are striven for, the maximum concentration used can be about 35 g/l. The pickling process can still be controlled at an upper limit of 40 g/l of free HF. At higher concentrations, however, the risk of overpickling increases. The minimum concentration of free sulfuric acid used is preferably between 55 and 60 g/l, the upper limit being between 70 and 100 g/l. For example, the pickling solution may contain 55 to 75 g/l of free sulfuric acid.

The concentration of Fe(III) ions decreases during the course of the pickling process because the ions are reduced to the divalent state by the redox reaction with elemental iron on the surface of the steel. The concentration of Fe(III) ions is preferably adjusted in such a way that the pickling solution in the thoroughly mixed state contains between about 10 and about 25 g/l of these ions. This is preferably achieved by oxidizing the Fe(II) ions being produced to the trivalent state, to the corresponding extent. Depending on the ratio of the amounts of divalent and trivalent iron ions present in the pickling solution, this solution has a specific redox potential. Thus, the pickling solution can also be controlled via the measured redox potential. In the case of the process according to the invention, the pickling solution in the thoroughly mixed state has a redox potential, measured at 25° C. with a platinum electrode and relative to an Ag/AgCl reference electrode, of preferably 100 to 240 mV, in particular of 150 to 235 mV. The redox potential drops during the course of the pickling process due to the consumption of trivalent iron ions and the formation of divalent iron ions. It can be raised again by oxidizing the divalent iron ions to the trivalent state. The redox potential in the process according to the invention is preferably adjusted by taking one or more of the following actions:

a) addition of a reagent to the pickling solution which is able to oxidise Fe(II) ions in the pickling solution to Fe(III) ions, preferably hydrogen peroxide or a hydrogen peroxide-releasing substance,
b) catalytic oxidation with an oxygen-containing gas using a homogeneous or heterogeneous oxidation catalyst,
c) electrochemical oxidation.

Thus, in order to oxidize divalent iron, and therefore to control the redox potential, direct oxidation with a strong oxidizing agent such as hydrogen peroxide or a hydrogen peroxide-releasing substance is possible. Such substances are, for example, inorganic or organic peracids or peroxoacids. For example, peroxosulfuric acid or peroxodisulfuric acid are suitable. Oxidizing halogen acids such as, for example, chloric acid or perchloric acid are possible, but are less preferred for practical reasons.

As an alternative to this, the divalent iron can be oxidized to the trivalent state by catalytic oxidation with an oxygen-containing gas, preferably with air, using a homogeneous or heterogeneous oxidation catalyst. Copper ions, for example, may be used as a homogeneous oxidation catalyst, as is described in German patent application DE-A-197 55 350. If the presence of copper ions in the pickling solution is to be avoided, the divalent iron can be oxidized catalytically to the trivalent state in an external fixed bed reactor, using oxygen or air. Such a process is disclosed in EP-A-795 628.

Finally, the divalent iron can be oxidized to the trivalent state directly or indirectly by electrochemical oxidation. Such a process is described, for example, in WO 00/15880 and in the literature cited therein.

From the above, it can be seen that the concentration of Fe(II) ions in the pickling solution depends on the operational status of the pickling solution. In a freshly prepared pickling solution, this concentration may be 0. It increases during the course of the pickling process, wherein the increase is controlled by oxidizing Fe(II) to Fe(III) The concentration of Fe(II) can then rise to 70 to 80 g/l. During practical trials with the pickling process according to the invention, Fe(II) concentrations in the range between 40 and 60 g/l were observed after a period of operation of one week. If the total concentration of divalent and trivalent iron ions increases to above a predetermined limiting value, which may be in the range, for example, of 90 to 110 g/l, it is recommended that some, for example ⅔, of the pickling solution be run off and replaced by fresh pickling solution which does not contain any Fe(II) ions. Only the acid then needs to be topped up because a sufficient quantity of Fe(III) ions generally remains in the solution. If required, some of the Fe(II) ions remaining can be oxidised to Fe(III). This lowers the concentration of Fe(II) ions still further, for example to a value in the region of 20 g/l.

In the process according to the invention, it may be preferable to move the pickling solution relative to the substrate surface, preferably by pumping round, stirring or blowing air through. This is the case in particular when the items to be pickled are present in the form of bundles or are rolled up in batches. Agitation of the pickling solution facilitates the exchange of pickling solution in narrow spaces between the surfaces being pickled and thus leads to uniform pickling results. Now, this is the case in particular when martensitic or ferritic stainless steel is present in the form of wires, tubes or rods. The process according to the invention is particularly suitable for these types of substrates.

Apart from the essential components mentioned, the pickling solution may also contain further auxiliary substances or additives. For example, it is conventional, in the case of oxidation with hydrogen peroxide, to add this in the form of a stabilized aqueous solution. The stabiliser for $H_2O_2$ gets into the pickling bath in this way. This is disclosed for example in EP-A-582 121 cited above, where 8-hydroxyquinoline, sodium stannate, phosphoric acid, salicylic acid, pyridinecarboxylic acid and in particular phenacetin are mentioned as stabilisers. A particularly preferred stabilizer for $H_2O_2$ is a mixture of phosphoric acid and glycol ether as is described, for example, in WO 01/49899. To produce a particularly uniformly pickled surface, it is an advantage if the pickling solution contains surface-active substances, in particular those of a non-ionic type. Examples of these are fatty alcohol ethoxylates or fatty alcohol ethoxylate/propoxylates. The length of the carbon chain in the fatty alcohol is then preferably in the range between 8 and 22, in particular between 12 and 18.

The pickling process according to the invention is generally one sub-step in the overall sequence of surface treatment procedures for the items mentioned. This treatment sequence includes, prior to pickling, a pretreatment during which the oxidic coating is applied and, after the pickling step, a passivating post-treatment in order to maintain the metallic polished appearance of the surface. Accordingly, the present invention also includes a sequential process for the surface treatment of martensitic or ferritic stainless steel, preferably of items in the form of wires, tubes or rods, wherein the stainless steel is at least a) subjected to a treatment during which the oxidic coating is applied, preferably sand-blasting or metal-blasting, treatment with a molten salt or treatment with an aqueous permanganate/alkali metal hydroxide solution,
b) pickled with the process according to one or more of Claims 1 to 6,
c) post-treated with a passivating solution.

Depending on the substrate, further treatment steps may be provided, for example prepickling with a solution which contains one or more acids (HCl, $H_2SO_4$, HF) between steps a) and b).

Washing and/or neutralising steps are also provided between the individual treatment steps, although these may also be omitted directly after sand-blasting and/or metal-blasting. A treatment a), application of the oxidic layer, is a conventional procedure used in the prior art before pickling treatment. The named permanganate/alkali metal hydroxide solution is preferably a solution which contains 5 to 20 wt. % NaOH and 5 to 20 wt. % of potassium permanganate. This solution preferably has a temperature in the range 95 to 100° C. If alkaline products are used in step a), a neutralization procedure is preferably provided before step b), for example treatment of the substrate with dilute sulfuric acid. This may also be a sensible procedure to use after sand-blasting and/or metal-blasting.

The passivating solution for sub-step c) has to have a redox potential which (under the same measuring conditions) is higher than the potential used in step b), for example in the range about 600 to about 800 mV. A nitric acid-containing solution, for example, is suitable for this, but is less preferred for reasons related to protection of the environment. As an alternative to this, a passivating solution can be used which contains sulfuric acid and hydrogen peroxide. In this case, the passivating solution preferably also contains a stabiliser for $H_2O_2$, for example a mixture of phosphoric acid and glycol ether in accordance with WO 01/49899. In both cases, the passivating solutions may also contain low concentrations of HF, for example in the region of 5 g/l. In passivation step c), dark coatings on the substrate surface, which can be produced in pickling step b), are also removed.

It may be advantageous, to produce uniform pickling results, to repeat steps a) and b) once or several times. For example, a process sequence according to the invention may be designed as follows:

1. Pretreatment with an aqueous solution which contains 10 wt. % of each of NaOH and $KMnO_4$ and has a temperature of 95° C., for a period of 20 minutes.
2. washing with water or preferably washing with a neutralizing solution containing dilute sulfuric acid.
3. Pickling treatment according to the invention using one of the two pickling baths in accordance with the table given below, temperature 28° C., 10 minutes.
4. Washing with water, preferably a high-pressure spray-wash procedure.
5. Repeated pretreatment as described under 1.
6. Washing with water.
7. Repeated pickling treatment as described under 3.
8. Washing with water as described under 4.
9. Passivating treatment in nitric acid or in a passivating/shine-retaining solution in accordance with WO 01/49899, which contains sulfuric acid, $H_2O_2$ and a stabilizer mixture of phosphoric acid and glycol ether (e.g., ethylene glycol or diethylene glycol mono-n-butyl ether).

10. Washing with water, preferably with a spray.

11. Optionally, a neutralization treatment, for example with lime.

As an alternative to this, suitable substrates can be initially sand-blasted and/or metal-blasted in sub-step a) Then, in sub-step b), pickling treatment is performed at 28° C. for a period in the range 5 to 10 minutes, followed by washing with water and passivation step c) as described under 9.

In a successful practical trial, 2 pickling solutions were used which had a composition, after an operational period of one week, in accordance with the table given below. The redox potential and the concentration of Fe(II) were adjusted by the addition of $H_2O_2$. The acid concentrations refer to the concentrations of free acid.

TABLE

Pickling solutions according to the invention (concentrations in g/l)

| | Solution 1 | Solution 2 |
|---|---|---|
| $H_2SO_4$ | 60.7 | 68.5 |
| HF | 33.0 | 33.4 |
| $Fe2^+$ | 55.0 | 44.4 |
| $Fe3^+$ | 10.1 | 13.5 |
| E, mV (Ag/AgCl/Pt; T = 25° C.) | 199 | 229 |
| Pickling temperature | 28° C. | 28° C. |

What is claimed is:

1. A process for pickling martensitic or ferritic stainless steel, said process comprising contacting the martensitic or ferritic stainless steel with a pickling solution comprising:

5 to 13.5 g/l of Fe(III) ions, an amount of Fe(II) such that the total amount of Fe(III)+Fe(II) is not above a limiting value of 110 g/l, 50 to 120 g/l of free sulfuric acid and 5 to 40 g/l of free HF at a temperature in the range 15 to 29° C., for a time of 5 to 25 minutes, said pickling solution having a redox potential, measured at 25° C. with a platinum electrode and relative to an Ag/AgCl reference electrode, of 100 to 240 mV.

2. A process according to claim 1, wherein the pickling solution comprises 55 to 75 g/l of free sulfuric acid.

3. A process according to claim 1, wherein the pickling solution has a redox potential, measured at 25° C. with a platinum electrode and relative to an Ag/AgCl reference electrode, of 100 to 229 mV.

4. A process according to claim 1, wherein the pickling solution has a redox potential, measured at 25° C. with a platinum electrode and relative to an Ag/AgCl reference electrode, of 150 to 235 mV.

5. A process according to claim 1, additionally comprising adjusting the redox potential by taking one or more of the following actions:

a) adding a reagent to the pickling solution which is able to oxidize Fe(II) ions in the pickling solution to Fe(III) ions;

b) catalytically oxidizing the pickling solution with an oxygen-containing gas using a homogeneous or heterogeneous oxidation catalyst;

c) electrochemically oxidizing the pickling solution.

6. A process according to claim 1, additionally comprising adjusting the redox potential by adding to the pickling solution at least one reagent selected from the group consisting of hydrogen peroxide and hydrogen peroxide-releasing substances.

7. A process according to claim 1, wherein the pickling solution is moved about relative to the stainless steel during said contacting.

8. A process according to claim 1, wherein the martensitic or ferritic stainless steel is in a form selected from the group consisting of wires, tubes and rods.

9. A process according to claim 1, additionally comprising applying an oxidic coating to the stainless steel prior to said contacting with said pickling solution.

10. A process according to claim 1, additionally comprising applying an oxidic coating to the stainless steel prior to said contacting with said pickling solution by at least one method selected from the group consisting of sand-blasting, metal-blasting, treating with a molten salt, and treating with an aqueous permanganate/alkali metal hydroxide solution.

11. A process according to claim 1, additionally comprising post-treating the stainless steel with a passivating solution after said contacting with said pickling solution.

12. A process according to claim 1, additionally comprising applying an oxidic coating to the stainless steel prior to said contacting with said pickling solution and post-treating the stainless steel with a passivating solution after said contacting with said pickling solution.

13. A process according to claim 1, wherein said temperature is from 23 to 28.5° C.

14. A process according to claim 1, wherein free HF is present in the pickling solution at a concentration of at least 10 g/l.

15. A process according to claim 1, wherein prior to contacting with the pickling solution the stainless steel is prepickled with a solution comprising an acid.

16. A process for pickling martensitic or ferritic stainless steel, said process comprising:

applying an oxidic coating to the martensitic or ferritic stainless steel;

contacting the martensitic or ferritic stainless steel with a pickling solution consisting of 5 to 40 g/l of Fe(III) ions, 50 to 120 g/l of free sulphuric acid and 5 to 40 g/l of free HF, and optionally an oxidizing agent and/or at least one of a surface-active substance and an $H_2O_2$ stabilizer at a temperature in the range 15 to 28° C. and for a time in the range of 5–25 minutes; said pickling solution having a redox potential, measured at 25° C. with a platinum electrode and relative to an Ag/AgCl reference electrode, of 100 to 229 mV; and post-treating the martensitic or ferritic stainless steel with a passivating solution after said contacting with said pickling solution.

17. A process according to claim 16, wherein the pickling solution comprises 10 to 25 g/l of Fe(III) ions.

18. A process according to claim 16, wherein the pickling solution has a redox potential, measured at 25° C. with a platinum electrode and relative to an Ag/AgCl reference electrode, of 199 to 229 mV.

19. A process for pickling martensitic or ferritic stainless steel, said process comprising contacting the martensitic or ferritic stainless steel with a pickling solution consisting of 5 to 10.1 g/l of Fe(III) ions, 50 to 120 g/l of free sulfuric acid, 5 to 40 g/l of free HF, an amount of Fe(II) such that the total amount of Fe(III)+Fe(II) is not above a limiting value of 110 g/l, at a temperature in the range 15 to 28° C.; said pickling solution having a redox potential, measured at 25° with a platinum electrode and relative to an Ag/AgCl reference electrode, of 100 to 240 mV.

20. A process according to claim 19, wherein the pickling solution further comprises an oxidizing agent and/or at least one of a surface-active substance and an $H_2O_2$ stabilizer.

21. A process according to claim 19, additionally comprising adjusting the redox potential by taking one or more of the following actions:

a) adding a reagent to the pickling solution which is able to oxidize Fe(II) ions in the pickling solution of Fe(III) ions;

b) catalytically oxidizing the pickling solution with an oxygen-containing gas using a homogeneous or heterogeneous oxidation catalyst;

c) electrochemically oxidizing the pickling solution.

22. A process according to claim 19, additionally comprising adjusting the redox potential by adding to the pickling solution at least one reagent selected from the group consisting of hydrogen peroxide and hydrogen peroxide-releasing substances.

* * * * *

UNITED STATES PATENT AND TRADEMARK OFFICE

CERTIFICATE OF CORRECTION

PATENT NO. : 7,229,506 B2
APPLICATION NO. : 10/860911
DATED : June 12, 2007
INVENTOR(S) : Giordani et al.

It is certified that error appears in the above-identified patent and that said Letters Patent is hereby corrected as shown below:

On the title page, insert:
--(30) Foreign Application Priority Data
Dec. 7, 2001 (DE) 10160318.5--

Signed and Sealed this

Nineteenth Day of August, 2008

JON W. DUDAS
*Director of the United States Patent and Trademark Office*